United States Patent [19]

Larson

[11] 3,939,396

[45] Feb. 17, 1976

[54] SHUNT A.C. VOLTAGE REGULATOR WITH MODIFIED FULL-WAVE BRIDGE

[75] Inventor: Raymond E. Larson, Fort Worth, Tex.

[73] Assignee: ECC Corporation, Euless, Tex.

[22] Filed: Feb. 6, 1974

[21] Appl. No.: 439,867

[52] U.S. Cl. ..... 323/8; 323/22 SC; 323/38; 323/75 F; 307/252 N; 320/39

[51] Int. Cl.[2] ..... G05F 1/44

[58] Field of Search ..... 323/8, 7, 38, 18, 22 SC, 323/34–37, 75 F; 307/252 R, 252 N, 321; 322/28; 320/39

[56] References Cited

UNITED STATES PATENTS

| | | | |
|---|---|---|---|
| 3,076,129 | 1/1963 | Bockemuehl | 323/75 F |
| 3,341,763 | 9/1967 | Noddin | 320/39 |
| 3,355,650 | 11/1967 | Tolmie | 323/8 |
| 3,522,522 | 8/1970 | Tiemann | 323/22 SC |
| 3,711,761 | 1/1973 | Watson | 323/22 SC |
| 3,729,651 | 4/1973 | Fricker et al. | 307/252 N |
| 3,757,199 | 9/1973 | Minks | 322/28 |

*Primary Examiner*—Gerald Goldberg
*Attorney, Agent, or Firm*—Giles C. Clegg, Jr.

[57] ABSTRACT

A semiconductor switching device is connected in shunt with an A.C. voltage source to be regulated. A modified full-wave bridge rectifier is connected across the voltage source by a first pair of diagonally opposite nodes. A control circuit including a capacitor is connected across the output between a second pair of diagonally opposite nodes of the bridge rectifier to control a gate electrode of the switching device to control the triggering of the switching device in response to the voltage across the bridge rectifier output. The triggering of the switching device regulates the voltage supplied by the voltage source. The bridge rectifier includes an impedance network comprising first and second resistors branching from one of the nodes of the second diagonal pair, each resistor being connected via a diode to a different node of the first diagonal pair. The impedance network also includes a third resistor coupled between the junction of the first resistor and corresponding diode and the junction of the second resistor and corresponding diode.

11 Claims, 3 Drawing Figures

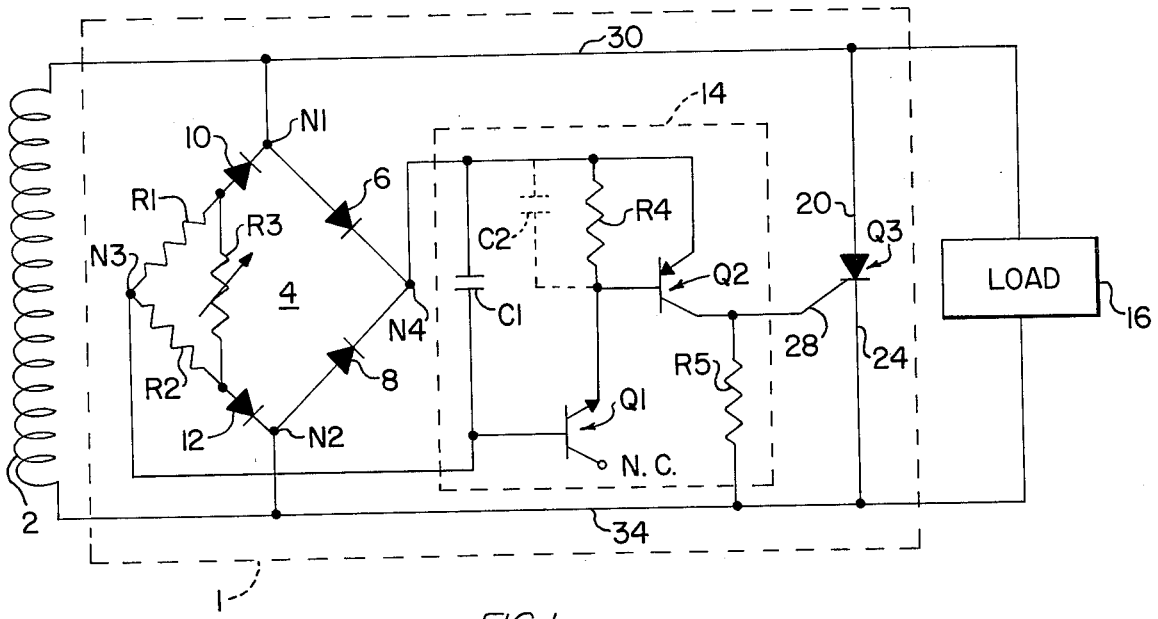
FIG. 1
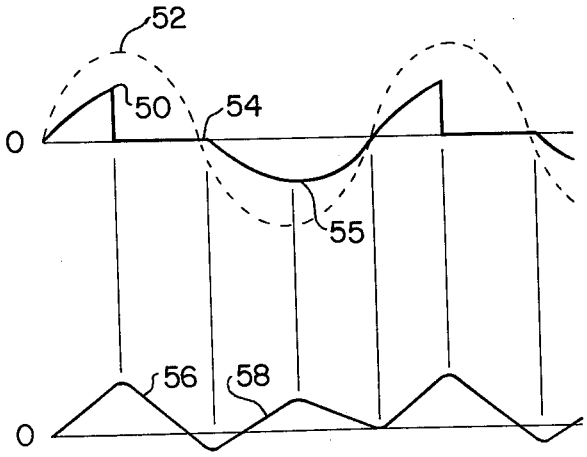
FIG. 2A
FIG. 2B

SHUNT A.C. VOLTAGE REGULATOR WITH MODIFIED FULL-WAVE BRIDGE

BACKGROUND OF THE INVENTION

This invention relates to a voltage regulator for use with current limited A.C. voltage sources.

Various types of smaller size passenger-carrying vehicles such as, for example, motorcycles, trail bikes. snowmobiles, garden tractors and the like employ magneto type voltage generators for generating the vehicle ignition voltage. Where such vehicles are equipped with headlights, tail lights, brake lights, horns and the like, it is common practice to also use the magneto generated voltage to operate the auxiliary devices. One problem associated with this practice is that the output voltage of a magneto varies over a relatively wide range as the speed of the vehicle motor is varied. As a consequence, it is difficult to provide headlights, tail lights and the like which give desired brightness levels at lower operating speeds and yet which are not damaged or blown out by the larger voltages which occur throughout the higher operating speeds.

A number of possible solutions have been suggested for limiting the magneto output voltage to some predetermined level. Both peak level voltage regulators for limiting the peak value of the magneto output voltage and root-mean-square (R.M.S.) voltage regulators for limiting the R.M.S. value of the magneto output voltage have been suggested. It has been found, however, that peak level voltage regulators cause a noticeable flickering of the light at some operating speeds. Also, the lights do not provide the desired brightness at all the different operating speeds using a peak level voltage regulator. Although R.M.S. voltage regulators overcome some of the problems of the peak level voltage regulators, R.M.S. voltage regulators require an R.M.S. voltage sensing means such as a lamp or heater element and for this reason are rather expensive and subject to a higher than desirable failure rate.

SUMMARY OF THE INVENTION

It is an object of the present invention to provide a simple, inexpensive and reliable voltage regulator for use with current limited A.C. voltage sources.

It is also an object of the present invention to provide a voltage regulator which is compatible with A.C. voltage sources having differing output characteristics.

It is another object of the present invention to provide a voltage regulator whose operating characteristics are substantially immune from ambient temperature variations.

These and other objects of the present invention are realized in a specific illustrative embodiment which includes a semiconductor switching device having a control electrode, and two power electrodes connected in shunt with an A.C. voltage source to be regulated. A modified full-wave bridge rectifier is also connected by a pair of diagonally opposite nodes in shunt with the voltage source and by a second pair of diagonally opposite nodes to a control circuit which, in response to the voltage impressed across the second pair of nodes, applies control signals to the control electrode of the semiconductor switching device to control the conductivity between the power electrodes thereof. In accordance with one aspect of the invention, the rectifier includes an impedance network which presents a first impedance for current flowing in one direction through the rectifier and for presenting a second impedance for current flowing in the other direction through the rectifier. The impedance network thus determines the voltage impressed across the second pair of nodes of the rectifier and therefore the generation of the control signals.

BRIEF DESCRIPTION OF THE DRAWINGS

The above and other objects and advantages of the present invention will best be understood by reference to the following description of a preferred embodiment of the present invention taken in conjunction with the accompanying drawings in which:

FIG. 1 is a schematic circuit diagram showing a voltage regulator made in accordance with the principles of the present invention;

FIGS. 2A and 2B are wave-forms used in explaining the operation on the circuit of FIG. 1.

DETAILED DESCRIPTION

Referring to FIG. 1, there is shown a voltage regulator 1 for regulating the output of an A.C. voltage source represented by winding 2. Winding 2 could, for example, be the field winding of a magneto type voltage generator in which case the permanent magnet rotor (not shown) of the magneto would be mechanically coupled to the motor of a motor vehicle. The regulated output of the winding 2 is applied to a load 16 which might, for example, be some auxiliary device or devices on the motor vehicle such as a healight, tail light or tachometer.

The voltage regulator 1 is a shunt type voltage regulator which operates to limit the voltage applied to the load 16 while at the same time enabling sufficient electrical power to be supplied thereto to properly operate the load. As will be understood from the discussion below, the voltage regulator 1 periodically places a short circuit across the winding 2. This will be done, if at all, at some point in time (angle) in every other half cycle of the output voltage of the winding 2. In this manner, the average power supplied by the winding 2 is regulated.

The voltage regulator 1 includes a semiconductor switching device Q3 having a pair of power electrodes 20 and 24 and a control electrode or gate electrode 28. The semiconductor switching device Q3 shown in FIG. 1 is preferably a silicon controlled rectifier (SCR) but may be a switching transistor. The switching device Q3 is connected by its power electrodes 20 and 24 and by way of conductors 30 and 34 in shunt with the winding 2.

The voltage regulator 1 also includes a full-wave bridge rectifier 4 also connected in shunt with the winding 2 by way of a first pair of diagonally opposite nodes n1 and *n*2. The rectifier 4 includes four diodes 6, 8, 10 and 12, each connected in a predetermined, well-known manner in one of four arms of the bridge rectifier. An impedance network, including resistors R1 and R2 and an adjustable resistor R3, comprises a modification of the bridge rectifier 4. Resistor R1 is connected in series with the diode 10 between nodes *n*1 and *n*3. Resistor R2 is connected in series with the diode 12 between nodes *n*2 and *n*3. The adjustable resistor R3 interconnects the junction between the resistor R2 and the diode 12 and the junction between the resistor R1 and the diode 10.

By ajustment of the adjustable resistor R3, the impedance presented by the rectifier 4 can be varied. Also, by appropriate selection of the resistance values of resistors R1 and R2, the impedance in one direction through the rectifier 4 can be made different from that in the other direction.

Finally, the voltage regulator 1 includes a control circuit 14 connected across the nodes *n*3 and *n*4 of the bridge rectifier 4 and coupled to the control electrode 28 of the semiconductor switching device Q3. The control circuit 14 includes a capacitor C1 connected across the nodes *n*3 and *n*4, a transistor Q2 whose collector is coupled to the control electrode 28 and whose emitter is coupled to one side of the capacitor C1, and a semiconductor avalanche device Q1 coupled between the base of the transistor Q2 and one side of the capacitor C1. The device Q1 shown in FIG. 1 comprises simply a transistor whose base is connected to one side of the capacitor C1 and whose emitter is connected to the base of the transistor Q2. The collector electrode of the transistor Q1 is unconnected. A Zener diode (for example) could be used in place of the transistor Q1 as the avalanche device, but the transistor is inexpensive and, has a much sharper reverse knee characteristic. A resistor R4 is connected across the base-emitter junction of the transistor Q2.

As briefly indicated earlier, the voltage regulator 1 operates as a shunt type regulator to place a short circuit across the voltage source or winding 2 for a controlled fraction of every other half cycle of the A.C. voltage developed across the winding provided the voltage developed by the winding 2 is sufficient. Assume that for the first half cycle of the A.C. voltage output of winding 2 conductor 30 is positive with respect to conductor 34. As the voltage on the conductor 30 increases, current flows via diode 6 to the capacitor C1, and via the impedance network comprising resistors R1, R2 and R3, and through the diode 12 to conductor 34. The rate at which the capacitor C1 is charged of course, depends, upon the constant of the RC circuit composed of resistors R1, R2 and R3 and capacitor C1 and upon the voltage output of winding 2. The resistance presented by the resistors during this half cycle of the output of the winding 2 is $$\frac{r2(r1+r3)}{r1+r2+r3}$$

Where *r*1, *r*2 and *r*3 represent the resistances respectively of resistors R1, R2 and R3. Because the resistance of the resistor R3 may be adjusted, the previously mentioned time constant can be varied.

As the capacitor C1 charges, the voltage thereacross increases until it exceeds the avalanche level of the base-emitter junction of the transistor Q1. When this occurs, current flows through the resistor R4. When the voltage drop thereby created across the resistor R4 reaches some predetermined level, the transistor Q2 is caused to turn on and apply current to the control electrode 28 of the switching device Q3. The switching device Q3 is thus triggered into a conductive condition to short circuit the winding 2. The switching device Q3 continues in its conductive condition until the end of the half cycle of the output of the winding 2. i.e., until the voltage applied to conductor 30 becomes negative.

FIG. 2A shows a portion of the waveform of the voltage appearing between conductors 30 and 34, and FIG. 2B shows a portion of the waveform of the voltage appearing across the capacitor C1. As can be seen in FIG. 2A, at some point in the positive half cycle (indicated by reference numeral 50), the switching device Q3 becomes conductive to provide a short circuit between conductors 30 and 34; when this occurs, the source voltage for charging the capacitor C1 is removed and, as shown in FIG. 2B, the voltage across the capacitor C1 begins to decrease (portion 56 of the curve) as the capacitor discharges.

The dotted line curve 52 of FIG. 2A represents the voltage output of the winding 2 when no load is placed across the winding and when no shunting occurs. As a result of shunting the winding 2 in the positive half cycle and because of the characteristics of megnetos, a time lag (represented by portion 54 of the FIG. 2A curve) occurs in the negative half cycle. The capacitor C1 continues to discharge until a negative voltage is placed on conductor 30 at which time the capacitor begins to charge as represented by portion 58 of the FIG. 2B curve. Although not specifically indicated in FIG. 2B, the voltage across the capacitor C1 generally remains near the avalanche voltage of the base emitter junction of transistor Q1.

During the negative half cycle, current is applied from the conductor 34 via diode 8 to the capacitor C1 and via the impedance network of the rectifier 4 and the diode 10 to the conductor 30. As before, the rate at which the capacitor C1 is charged is dependent upon the RC time constant of the circuit composed of resistors R1, R2 and R3 and capacitor C1 and upon the voltage output of winding 2. The impedance presented by the impedance network during the negative half cycle is $$\frac{r2(r1+r3)}{r1+r2+r3}$$

As can be seen from this expression, unless the value of the resistors R1 and R2 are the same, different impedances will be presented by the rectifier 4 for opposite half cycles of the voltage output of the winding 2. The specific impedances presented, of course, can be varied by adjusting the adjustable resistor R3. The advantage of providing different impedances for opposite half cycles and thus different capacitor C1 charging times for opposite half cycles is that amplitude differences between the positive and negative half cycles of the output of the winding 2 can be utilized to control the turn-on point of the switching device Q3. The amplitude and waveform differences between the positive and negative half-cycles of the applied voltage is determined by the magneto 2, the motor speed and the load. The time lag 54 (FIG. 2A) varies for different types of magneto construction and magnetic materials. Thus, by changing the ratio between the resistors R1 and R2, optimum output voltage regulation for a particular magneto construction can be obtained.

When, during a negative half cycle, the current through the resistor R4 exceeds the avalanche of Q1, the transistor Q2 becomes conductive and supplies current to the gate electrode 28 of the switching device Q3. However, because the switching device Q3 of FIG. 1 is an SCR, during this half cycle of the output of the winding 2, the switching device Q3 is backed baised and does not become conductive to short circuit the conductors 30 and 34. This is illustrated in FIG. 2A by portion 55 of the curve. Rather, the voltage across the capacitor C1, increases until the output voltage of the winding 2 reaches its negative-most level after which the capacitor voltage begins to decrease.

The voltage regulator 1 continues to operate for successive half cycles in the same manner as described above. At some point in each positive half cycle, the switching device Q3 is triggered to conduct current and thus short circuit the output of the winding 2. During each negative half cycle, no shunting occurs. As the voltage output of the winding 2 is increased (for example, because the RPM of the magneto represented by winding 2 increases), the switching device Q3 triggers earlier in the positive half cycle (because the capacitor C1 charges more quickly) so that the average voltage applied to the load 16 remains constant, i.e., the increase in voltage output of the winding 2 is compensated by shunting earlier in each positive half cycle. As the voltage output of the winding 2 decreases, the triggering of the switching device Q3 occurs later in each positive half cycle (because of increased charging times of the capacitor C1) to again maintain substantially constant the average voltage applied to the load 16.

The combination of the capacitor C1 and the transistors Q1 and Q2 further provides temperature compensation for the regulator 1.

The voltage across a forward-biased P-N junction, such as the base-emitter junction of the transistor Q2, decreases with increasing temperature, thus displaying a negative temperature coefficient. Conversely, a reverse-biased P-N junction, for example the base-emitter junction of the transistor Q1, which is in an avalanche breakdown condition, displays a positive temperature coefficient, that is, the voltage across the junction increases as the temperature increases. Thus, the combination of a forward-biased junction and a reversed-biased junction can achieve temperature compensation.

In the voltage regulator 1 of FIG. 1, small voltage variations caused by changes in temperature are compared against the much higher voltage across capacitor C1. If the capacitor C1 was merely connected across the resistor R4 as in some prior art voltage regulators, the voltage change with temperature would be compared the relatively small voltage required to bias the transistor Q2 into conduction, thus having a greater effect upon the performance of the voltage regulator. It may be desirable to provide a capacitor C2 across 24, as shown in phantom in FIG. 1, to filter out voltage spikes which might otherwise cause the premature "turn on" of the transistor Q2.

Although the invention has been described with respect to a particular preferred embodiment thereof, various changes and modifications will become apparent to those skilled in the art which come within the spirit and scope of the invention as defined in the appended claims.

What is claimed is:

1. A voltage regulator for a current limited A.C. voltage source comprising:

a semiconductor switching device having a pair of power electrodes and a control electrode;

means for connecting the switching device by its power electrodes in shunt with the voltage source;

means for connecting a load in shunt with said switching device;

a full-wave bridge rectifier, a first node of which is connected to one of said power electrodes and a second node of which is connected to the other of said power electrodes, said first and second nodes being located diagonally opposite each other in said rectifier, said rectifier including a first diode, one electrode of which is connected to said first node, a first impedance means connected in series between the other electrode of said first diode and a third node of the rectifier, a second diode, one electrode of which is connected to said second node, a second impedance means connected in series between the other electrode of said second diode and said third node, a third impedance means interconnecting the junction of said first diode and said first impedance means with the junction of said second diode and said second impedance means, a third diode connected between said first node and a fourth node, a fourth diode connected between said second node and said fourth node, and central circuit means connected across said third node and said fourth node of said bridge rectifier and responsive to the voltage impressed across said third and fourth nodes for applying a control signal to the control electrode of the switching device to thereby cause the switching device to become conductive when the potential across its power electrodes is of the proper polarity, said control circuit means including a transistor whose emitter-collector circuit is coupled in series between the control electrode of the switching device and the fourth node of said rectifier, a semiconductor avalanche device coupled between the third node of said rectifier and the base of said transistor, fourth impedance means coupled between the base and the emitter of said transistor, and a capacitor coupled between the fourth node of said rectifier and either the third node of said rectifier or the base of said transistor.

2. A voltage regulator as in claim 1 wherein said third impedance means comprises an adjustable impedance means.

3. A voltage regulator as in claim 1 wherein said capacitor is connected between the third and fourth nodes of said rectifier.

4. A voltage regulator as in claim 1 wherein said switching device comprises a silicon control rectifier, said transistor comprises a PNP type transistor whose emitter is connected to said one side of said capacitor and whose collector is connected to the control electrode of the silicon controlled rectifier, and said breakover device comprises an NPN type transistor whose emitter is connected to the base of the PNP type transistor and whose base is connected to said other side of said capacitor.

5. A voltage regulator for a current limited A.C. voltage source comprising:

a semiconductor switching device having a pair of power electrodes and a control electrode;

means for connecting the switching device by its power electrodes in shunt with the voltage source;

means for connecting a load in shunt with said switching device;

a full-wave bridge rectifier, a first node of which is connected to one of said power electrodes and a second node of which is connected to the other of said power electrodes, said first and second nodes being located diagonally opposite each other in said rectifier, said rectifier including a first diode, one electrode of which is connected to said first node, a first impedance means connected in series between the other electrode of said first diode and a third node of the rectifier, a second diode, one electrode of which is connected to said second node, a second impedance means connected in series between the other electrode of said second diode and said third node, a third impedance means interconnecting the junction of said first diode and said first impedance means with the junction of said second diode and said second impedance means, a third diode connected between said first node and a fourth node, a fourth diode connected between said second node and said fourth node, control circuit means connected across said third node and said fourth node of said bridge rectifier and responsive to the voltage impressed across said third and fourth nodes for applying a control signal to the control electrode of the switching device to thereby cause the switching device to become conductive when the potential across its power electrodes is of the proper polarity, said control circuit means including a capacitor connected across the third and fourth nodes of said bridge rectifier, a semiconductor avalanche device, means connecting the avalanche device across said capacitor to cause said avalanche device to switch to the low impedance state when the charge on the capacitor attains a level equal to the avalanche voltage of the avalanche device, and means responsive to said avalanche device switching to the low impedance state for applying a control signal to the control electrode of the switching device.

6. A voltage regulator for an A.C. voltage source comprising a semiconductor switching device having a pair of power electrodes and control electrode, means for connecting the switching device by its power electrodes in shunt with said voltage source, means for connecting a load in shunt with said switching device, a full-wave bridge rectifier coupled by a first pair of diagonally opposite nodes in shunt with the voltage source, a capacitor coupled across a second pair of diagonally opposite nodes of the rectifier, first impedance means connected in said bridge rectifier for controlling the charge rate of said capacitor, a transistor whose emitter-collector circuit is coupled in series between one plate of said capacitor and the control electrode of the switching device, a semiconductor avalanche device coupled between the other plate of said capacitor and the base of said transistor, and second impedance means coupled between the base and the emitter of said transistor, said avalanche device being switched to a low impedance state when the charge on the capacitor attains a level equal to the avalanche voltage of the of the avalanche device permitting flow of current to bias the transistor to a more conductive state and apply a current thru the emitter-collector circuit of the transistor to the control electrode of the switching device causing the switching device to switch to the low impedance state when the voltage across its power electrode is of the proper polarity.

7. A voltage regulator as in claim 6 wherein said switching device comprises a silicon controlled rectifier, and said avalanche device comprises a transistor whose emitter is connected to the base of the other transistor and whose base is connected to said other side of said capacitor.

8. A voltage regulator as in claim 6 further including a second capacitor connected in parallel with said second impedance means.

9. A voltage regulator as in claim 6 wherein said first impedance means includes a plurality of resistors connected in said bridge rectifier for presenting an impedance of $$\frac{r1(r2+r3)}{r1+r2+r3}$$

between a first node *n*1 of said first pair of nodes and a node *n*3 of said second pair of nodes and for presenting an impedance of $$\frac{r2(r1+r3)}{r1+r2+r3}$$

between a second node *n*2 of said first pair of nodes and said node *n*3, where *r*1, *r*2 and *r*3 each represent value of electrical resistance.

10. A voltage regulator as in claim 9 wherein said first impedance means includes a first resistor having a resistance *r*1 connected between said node *n*3 and a first diode of the rectifier, said first diode being coupled to said node *n*1, a second resistor having a resistance *r*2 connected between said node *n*3 and a second diode of the rectifier, said second diode being coupled to said node *n*2, and a third resistor having a resistance *r*3 connected between the junction of said first resistor and first diode and the junction of said second resistor and said second diode.

11. A voltage regulator as in claim 10 wherein said third resistor comprises an adjustable resistor.

* * * * *